United States Patent [19]

Suzuki et al.

[11] Patent Number: 5,022,303

[45] Date of Patent: Jun. 11, 1991

[54] MUSICAL TONE CONTROL APPARATUS EMPLOYING PREDICTED ANGULAR DISPLACEMENT

[75] Inventors: Hideo Suzuki; Masao Sakama, both of Hamamatsu, Japan

[73] Assignee: Yamaha Corporation, Hamamatsu, Japan

[21] Appl. No.: 352,096

[22] Filed: May 15, 1989

[30] Foreign Application Priority Data

May 18, 1988 [JP] Japan ..... 63-121491

[51] Int. Cl.[5] ..... G10H 1/32

[52] U.S. Cl. ..... 84/600; 84/603; 84/644

[58] Field of Search ..... 84/600, 615, 653, 678, 84/644, 670, 718; 128/782

[56] References Cited

U.S. PATENT DOCUMENTS

| | | | |
|---|---|---|---|
| 3,704,339 | 11/1972 | Niinomi | 84/678 X |
| 3,705,948 | 12/1972 | Tomisawa | 84/678 X |
| 4,557,275 | 12/1985 | Dempsey | 128/782 |
| 4,665,928 | 5/1987 | Linial et al. | 128/782 |
| 4,667,685 | 5/1987 | Fine | 128/782 |
| 4,905,560 | 3/1990 | Suzuki et al. | 84/600 |

FOREIGN PATENT DOCUMENTS

| | | |
|---|---|---|
| 62-172432 | 11/1987 | Japan . |
| 63-96697 | 4/1988 | Japan . |
| 63-115064 | 5/1988 | Japan . |
| 63-120214 | 5/1988 | Japan . |
| 63-123094 | 5/1988 | Japan . |
| 63-127773 | 5/1988 | Japan . |
| 63-132294 | 6/1988 | Japan . |
| 63-132295 | 6/1988 | Japan . |
| 63-132634 | 6/1988 | Japan . |
| 63-139208 | 6/1988 | Japan . |

*Primary Examiner*—Stanley J. Witkowski

*Attorney, Agent, or Firm*—Spensley Horn Jubas & Lubitz

[57] ABSTRACT

A musical tone control apparatus detects a bending angle of a player's joint portion such as a player's elbow joint portion, so that a musical tone control parameter such as a tone pitch of a musical tone to be generated is controlled based on the detected bending angle. In advance, the whole angle area ranging from the fully-bent-angle to the fully-stretched-angle at the player's joint portion is divided into several angle areas. Then, the present bending angle is picked up when a key-on switch is operated. If the present bending angle is increased as compared to the preceding bending angle, certain bending angle which is obtained by increasing the present bending angle is set as a future bending angle. If not, another bending angle which is obtained by decreasing the present bending angle is set as another future bending angle. In accordance with one of the angle areas to which the future bending angle will belong, musical tone control data is generated. Based on such musical tone control data, the parameter of the musical tone to be generated is controlled.

7 Claims, 5 Drawing Sheets

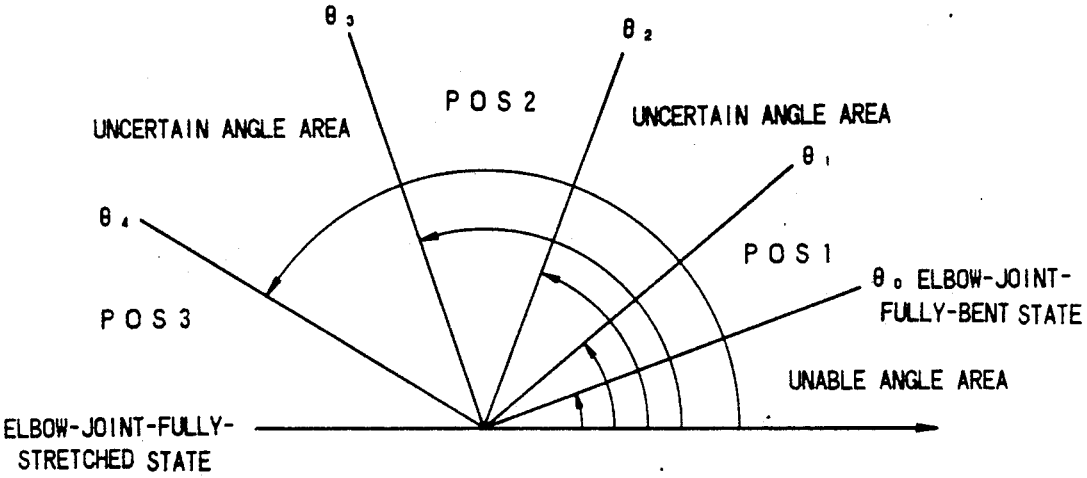

FIG. 5

| θ VALUE | RELATION BETWEEN θ & θ OLD | PREDICTED ANGLE AREA |
|---|---|---|
| $\theta_0 \leqq \theta < \theta_1$ | * | POS 1 |
| $\theta_1 \leqq \theta \leqq \theta_2$ | $\theta < \theta$ OLD | POS 1 |
| $\theta_1 \leqq \theta \leqq \theta_2$ | $\theta \geqq \theta$ OLD | POS 2 |
| $\theta_2 < \theta < \theta_3$ | * | POS 2 |
| $\theta_3 \leqq \theta \leqq \theta_4$ | $\theta < \theta$ OLD | POS 2 |
| $\theta_3 \leqq \theta \leqq \theta_4$ | $\theta \geqq \theta$ OLD | POS 3 |
| $\theta_4 < \theta$ | * | POS 3 |

* ; DO NOT CARE

FIG. 6

| ANGLE AREA OF ELBOW JOINT | | MUSICAL SCALE |
|---|---|---|
| LEFT | RIGHT | |
| POS 1 | POS 1 | $C^n$ |
| POS 1 | POS 2 | $D^n$ |
| POS 1 | POS 3 | $E^n$ |
| POS 2 | POS 1 | $F^n$ |
| POS 2 | POS 2 | $G^n$ |
| POS 2 | POS 3 | $A^n$ |
| POS 3 | POS 1 | $B^n$ |
| POS 3 | POS 2 | $C^{n+1}$ |
| POS 3 | POS 3 | $D^{n+1}$ |

MUSICAL TONE CONTROL APPARATUS EMPLOYING PREDICTED ANGULAR DISPLACEMENT

BACKGROUND OF THE INVENTION

The present invention relates to a musical tone control apparatus, and more particularly to a musical tone control apparatus which controls a musical tone based on a bending angle (or bent angle) of each of several joints (or articulations) of human body.

Conventionally, the musical tone is generated by performing a musical instrument such as a piano, a violin and the like or by vibrating the vocal chord of human. Therefore, the conventional apparatus does not convert a human motion according to rhythm exercises and the like into the corresponding musical tone at all.

Under such circumstances, the present applicant has developed the musical tone control apparatus capable of converting the movement of each portion of human body into the musical tone (see U.S. patent application Ser. No. 108,205 whose disclosure includes the contents of Japanese Patent Laid-Open Publication Nos. 63-115064, 63-132634, 63-120214, 63-132295, 63-139208, 63-96697, 63-127773, 63-132294). This apparatus comprises a detecting portion for detecting the bending angle of each joint; a grip device having the shape which can be held by a player's hand and also providing a key-on switch for designating a timing of generating the musical tone; and a main unit which inputs detection signals outputted from the detecting portion at the timing when the key-on switch is depressed (or turned on) so that the musical tone generated from a speaker can be controlled in response to the combination of inputted detection signals.

For example, a tone pitch of the musical tone is designated based on the combination of bending angles at left and right elbow joints of the player. Next, when the key-on switch at the grip device is depressed, the musical tone having the designated tone pitch is generated from the speaker. Thus, it is possible to control the musical tone in response to the movements of player's body.

However, the above-mentioned conventional musical tone control apparatus suffers the following problems because it is different from the general electronic keyboard musical instrument which simultaneously determines the key-on timing and tone pitch by a single depressing operation of a player's finger. At first, in order to raise performance speed, the player must move his elbow joints with high speed to sequentially and rapidly designate the desirable tone pitches. However, in some cases, the player depresses the key-on switch before the bending angle of elbow joint enters into an angle range for designating the next tone pitch whose musical tone is to be generated. For this reason, it is sometimes impossible to obtain the desirable tone pitch. As a result, there is a problem in that this conventional apparatus can perform only the music of relatively low technique or slow performance speed.

As other background techniques, Japanese Patent Laid-Open Publication No. 63-123094 and Japanese Utility Model Laid-Open Publication No. 62-172432 are known. These two inventions can generate the musical tone in response to the finger motion. However it is difficult to control the tone color of the musical tone to be generated.

SUMMARY OF THE INVENTION

It is accordingly a primary object of the present invention to provide a musical tone control apparatus which can perform the music of high technique or fast performance speed in addition to controlling the musical tone in response to the bending angles at several joint portions of the human body.

In a first aspect of the present invention, there is provided a musical tone control apparatus comprising:

(a) angle detecting means for detecting and then occasionally outputting angle information corresponding to a bending angle at a joint portion of a player's body;

(b) operating means for designating a timing of generating a musical tone responsive to an operation by a player;

(c) first holding means for holding the angle information which is outputted from the angle detecting means responsive to the operation, wherein the angle information to be held by the first holding means is set as present angle information;

(d) delay means for delaying the angle information occasionally outputted from the angle detecting means by a predetermined delay time, wherein the angle information delayed by the delay means is set as old angle information;

(e) second holding means for holding the old angle information responsive to the operation; and (f) control means for judging an increasing or decreasing tendency of the bending angle of player's joint portion based on the present angle information and old angle information, then estimating a future bending angle of player's joint portion under consideration of judgement result thereof and generating musical tone control data for controlling a musical tone generating apparatus based on estimation result thereof.

In a second aspect of the present invention, there is provided a musical tone control apparatus comprising:

(a) angle detecting means for detecting a bending angle of player's joint portion to thereby generate a detection signal corresponding to the bending angle of player's joint portion;

(b) means for outputting a key-on signal indicative of a key-on timing of generating a musical tone responsive to an operation by a player;

(c) delay means for delaying the detection signal by a predetermined delay time;

(d) first means for temporarily holding the detection signal delayed by the delay means as old angle information;

(e) second means for temporarily holding the detection signal directly outputted from the angle detecting means as present angle information; and (f) control means for detecting a motion of the player's joint portion based on the old angle information and the present angle information to thereby estimate a future bending angle of player's joint portion, so that the control means generates musical tone control data based on the future bending angle of player's joint, whereby a musical tone is to be generated based on the musical tone control data and the key-on signal.

In a third aspect of the present invention, there is provided a musical tone control apparatus comprising:

(a) right angle detecting means for detecting a right bending angle at a player's right joint portion to thereby generate a right detection signal corresponding to the right bending angle;

(b) left angle detecting means for detecting a left bending angle at a player's left joint portion to thereby generate a left detection signal corresponding to the left bending angle;

(c) means for outputting a key-on signal indicative of a key-on timing of generating a musical tone responsive to an operation by a player;

(d) right holding means for temporarily holding the right detection signal as present right angle information, the right holding means also delaying the right detection signal by a predetermined delay time to thereby temporarily hold a delayed right detection signal as old right angle information;

(e) left holding means for temporarily holding the left detection signal as present left angle information, the left holding means also delaying the left detection signal by the predetermined delay time to thereby temporarily hold a delayed left detection signal as old left angle information; and (f) control means for detecting a motion of the player's right joint portion based on the present right angle information and the old right angle information to thereby estimate a future right bending angle, the control means also detecting a motion of the player's left joint portion based on the present left angle information and the old left angle information to thereby estimate a future left bending angle, so that the control means generates musical tone control data based on a combination of the future right and left bending angles, whereby a musical tone is to be generated based on the musical tone control data and the key-on signal.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIG. 5 is a diagram showing a relation between the bending angle of player's elbow joint and angle area which is defined in the present embodiment;

FIG. 6 shows relations among angle data $\theta$, $\theta$OLD and estimated angle areas;

DESCRIPTION OF A PREFERRED EMBODIMENT

[A] Configuration and Operation of a Preferred Embodiment

Figure 1:
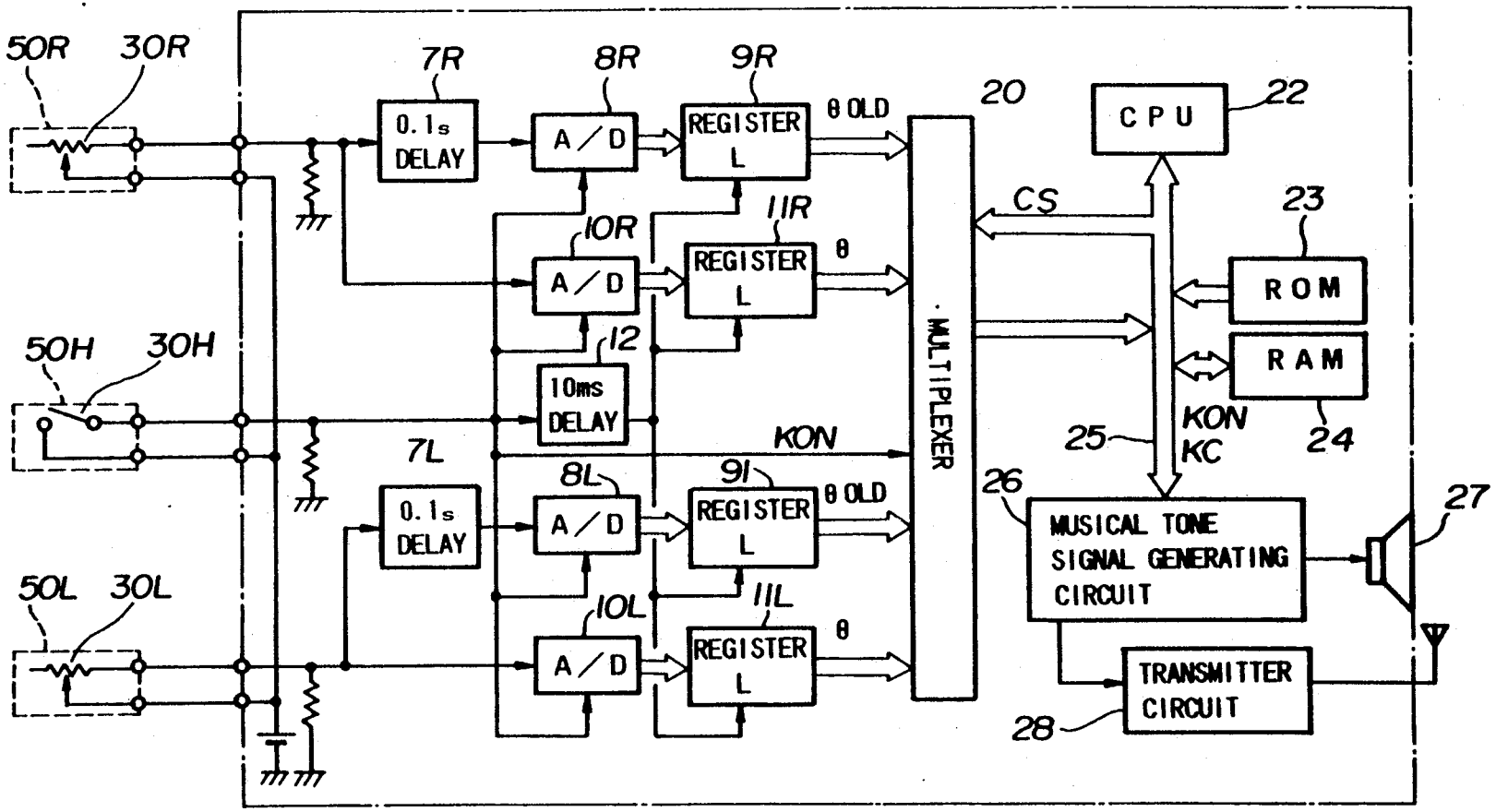
FIG. 1 is a block diagram showing an electric configuration of the musical tone control apparatus according to an embodiment of the present invention.
Figure 2:
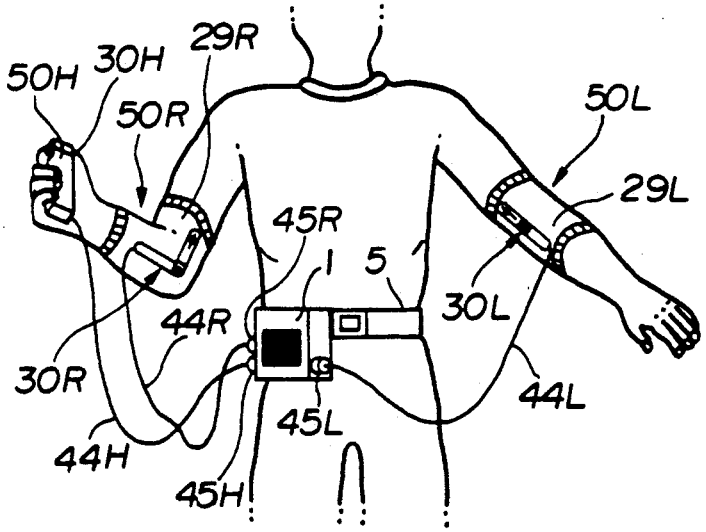
FIG. 2 is a front view showing the appearance of the present embodiment.

Next, description will be given with respect to a preferred embodiment of the present invention, wherein like reference characters designate like or corresponding parts throughout the several views, FIG. 1 shows the whole electric configuration of the musical tone control apparatus according to an embodiment of the present invention. FIG. 2 is a front view showing the appearance of the present embodiment which is mounted to the player's body. In FIGS. 1 and 2, 50R designates a detecting portion which is mounted at the player's right elbow portion, 50L designates another detecting portion which is mounted at the player's left elbow portion, and 50H designates a grip device having the shape which can be held by the player's right hand.

Figure 3:
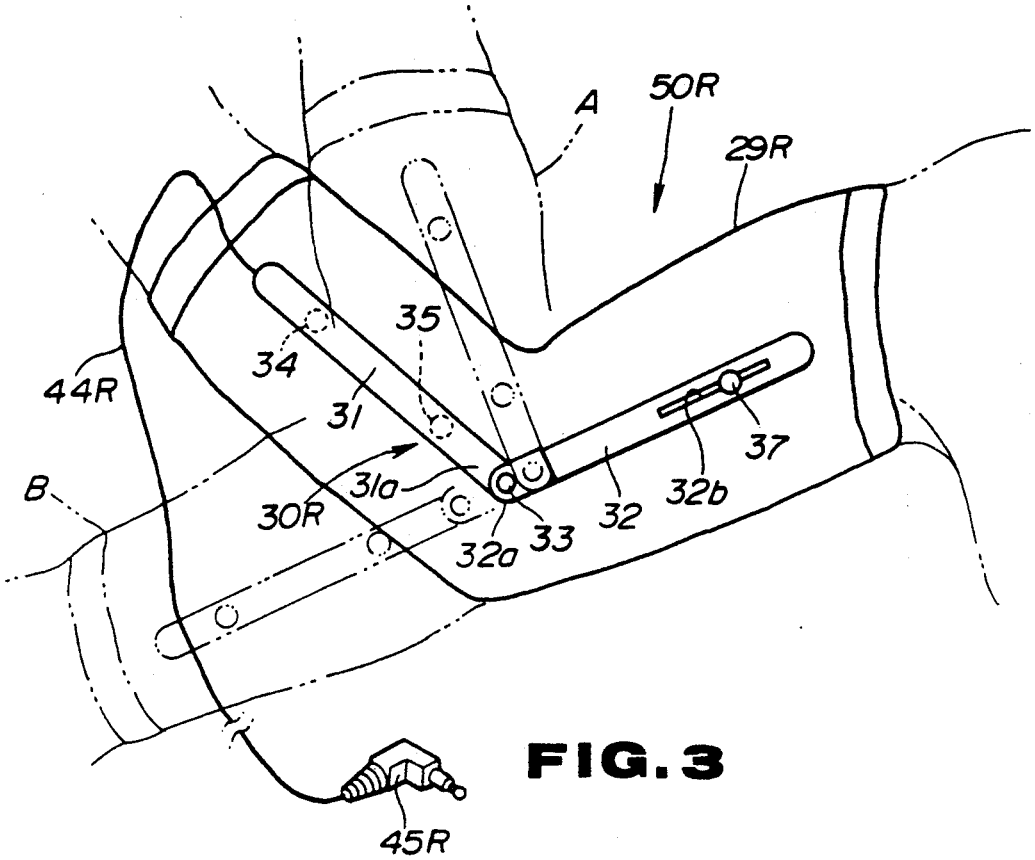
FIG. 3 is a view showing a mechanical configuration of an angle detector used in the present embodiment.

First, description will be given with respect to the configuration of the detecting portion 50R by referring to FIGS. 3 and 4. As shown in FIG. 3, the detecting portion 50R comprises a supporter 29R and an angle detector 30R. This supporter 29R is mounted at the elbow portion of the player's right arm, wherein this supporter is made of elastic fiber materials. The angle detector 30R is configured as follows. In the angle detector 30R, an edge portion of a plate 31 is connected to an edge portion 32*a* of a plate 32 by a pin 33 such that these plates 31 and 32 can freely revolve about the pin 33. These plates 31 and 32 are attached to the supporter 29R by hooks 34, 35 and 36, by which these plates can be easily detached from the supporter 29R. Each of these plates 31 and 32 is formed by a plastic plate and the like having the same size. At a back side of the plate 31, male sides of hooks 34 and 35 are attached. On the other hand, female sides of hooks 34 and 35 are attached to the supporter 29R. In addition, a long hole 32*b* is formed at the plate 32 in its longitudinal direction. Further, a movable member 37 is inset into this long hole 32*b* such that it can freely moved along the long hole 32*b*. Then, a male side of the hook 36 is attached at a back side of this movable member 37, while its corresponding female side is attached to the supporter 29R.

Figure 4:
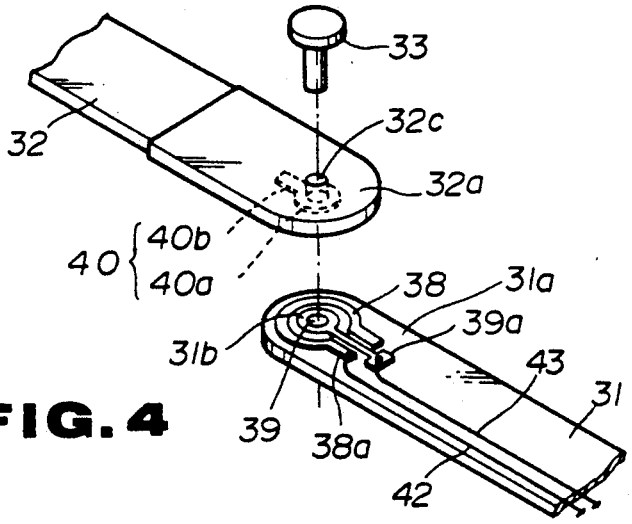
FIG. 4 is an exploded view of several members included in the angle detector shown in FIG. 3.

At each of facing sides of the edge portions 31*a* and 32*a* of plates 31 and 32, as shown in FIG. 4, a resistor 38, a fixed contact 39 and a sliding contact 40 all of which work as a potentiometer are provided. On the edge portion 31*a* of the plate 31, a hole 31*b* at which the pin 33 is fixed is formed. In addition, the fixed contact 39 is provided around this hole 31*b*. Further, the arc-shaped resistor 38 is provided on a virtual circle portion formed around the hole 31*b*. On the other hand, a hole 32*c* through which the pin 33 is to be inserted is formed at the edge portion 32*a* of the plate 32 such that the pin 33 can rotate within this hole 32*c*. In addition, the sliding contact 40 is formed in a manner that this sliding contact 40 can be in contact with the resistor 38 and fixed contact 39. This sliding contact 40 consists of a circular portion 40*a* and a convex portion 40*b*, wherein the resistor 38 can be slid along and be in contact with this convex portion 40*b* in accordance with the relative revolution between the plates 31 and 32. In addition, a lead 42 is connected to a terminal 38*a* provided at an edge portion of the resistor 38, while another lead 43 is connected to another terminal 39*a* provided at an edge portion of the fixed contact 39. Further, as shown in FIG. 3, these leads 42 and 43 are both connected to a connector 45R via a cable 44R.

Next, the player attaches this detecting portion 50R having the above-mentioned construction at his right elbow portion, and then he bends his right arm as shown by a two-dot chain line A or stretches his right arm as shown by another line B. In accordance with such bending and stretching movements of the player's right arm, the plate 32 must revolve about its axial pin 33 by certain angle. In accordance with this revolution, the convex portion 40*b* of the sliding contact 40 is slid along the resistor 38 so that the resistance between the terminal 38*a* of resistor 38 and the terminal 39*a* of fixed contact 39 must be varied in response to the position of the sliding contact 40, i.e., the bending angle of the player's right arm. In this case, with the revolution of the plates 31 and 32 in accordance with the bending and stretching movement of the player's right arm, the movable member 37 moved along the long hole 32*b*, which promotes the smooth movement of the player's right arm.

Next, as shown in FIG. 2, the detecting portion 50L consists of a supporter 29L and an angle detector 30L. This supporter 29L is mounted at the player's left elbow portion, while the angle detector 30L can be attached to and detached from the supporter 29L. Since this angle detector 30L has the same construction of the foregoing angle detector 30R, the description thereof will be omitted. Meanwhile, in FIG. 2, the grip device 50H which is held by the player's right hand is provided with a key-on switch 30H in addition to a tone volume designating switch, a tone color designating switch, an octave designating switch and the like. However, these switches other than the key-on switch 30H do not necessarily relate to the present invention, hence, the description thereof will be omitted.

The above-mentioned detecting portions 50R, 50L and the grip device 50H are respectively connected to a musical tone control main unit 1 via cables 44R, 44L, 44H and connectors 45R, 45L, 45H. This main unit 1 is designed to be mounted to the player's waist, wherein this main unit 1 is configured as shown in FIG. 1.

In FIG. 1, 7R designates an analog delay circuit which delays a detection signal supplied from the angle detector 30R by a delay time of 0.1 sec, wherein this detection signal corresponds to the bending angle of player's right elbow. Then, such delayed detection signal is converted into digital data of predetermined bits (e.g., eight bits) in an analog-to-digital (A/D) converter 8R. This digital data is stored in a register 9R. In addition, the detection signal from the angle detector 30R is directly converted into another digital data in another A/D converter 10R, and then such digital data is stored in a register 11R. Each of these A/D converters 8R and 10R starts to execute its analog-to-digital conversion (A/D conversion) at a timing when the key-on switch 30H provided to the grip device 50H is depressed so that a level of key-on signal KON outputted from the key-on switch 30H rises up to a high ("H") level. Then, a delay circuit 12 delays this key-on signal KON by a delay time of 10 milli-seconds (ms) corresponding to the time which is required for the above A/D conversion. Such delayed key-on signal is supplied to load terminals L of registers 9R and 11R. Thus, the register 11R stores the digital data whose value corresponds to the bending angle of right elbow joint at the present time when the key-on switch 30H is depressed, and then such digital data is outputted as angle data $\theta$. In addition, another register 9R stores the digital data corresponding to another bending angle of right elbow joint at the previous time which is prior to the above present time by 0.1 sec, and then such digital data is outputted as old angle data $\theta$OLD.

The above description is given with respect to several elements 7R to 11R provided in correspondence with the angle detector 30R. In addition to these elements, the main unit 1 includes other elements 7L to 11L provided in correspondence with another angle detector 30L. These two sets of elements correspond to each other, hence, description of the elements 7L to 11L will be omitted.

Next, 20 designates a multiplexer which selects one of the old angle data $\theta$OLD from the registers 9R, 9L, the angle data $\theta$ from the registers 11R, 11L and the key-on signal KON supplied from the key-on switch 30H based on a channel select signal CS supplied to its select terminal. Further, 22 designates a central processing unit (CPU). Furthermore, 23 designates a read-only memory (ROM) for storing programs used in the CPU 22, and 24 designates a random-access memory (RAM) which is used as a work area.

The CPU 22 supplies the channel select signal CS, whose value is sequentially varied, to the multiplexer 20 to thereby scan the outputs of registers 9R, 9L, 11R, 11L and key-on switch 30H with high speed. At the time when it is detected that the key-on signal KON is supplied to the multiplexer 20, the CPU 22 judges the increasing or decreasing tendency of the bending angle of right elbow joint based on two angle data $\theta$OLD and $\theta$ respectively supplied from the registers 9R and 11R. By considering such judgement result, the CPU 22 estimates the angle area to which the future bending angle of right elbow joint will belong. This estimation will be described later in detail. Similarly, the CPU 22 judges the increasing or decreasing tendency of the bending angle of left elbow joint based on two angle data $\theta$OLD and $\theta$ respectively supplied from the registers 9L and 11L. By considering such another judgement result, the CPU 22 estimates another angle area to which the future bending angle of left elbow joint will belong. Moreover, based on these two estimation results, the CPU 22 makes key code data K which designates the key code of the musical tone to be generated in response to the combination of the bending angles of right and left elbow joints. Then, this key code data KC and the key-on signal KON are both supplied to a musical tone signal generating circuit 26 via a bus line 25. This musical tone signal generating circuit 26 generates the musical tone signal whose tone pitch corresponds to the key code data KC. This musical tone signal is then supplied to a speaker 27, from which the corresponding musical tone is generated. Meanwhile, 28 designates a transmitter circuit 28 which transmits the musical tone signal from the circuit 26 by wireless.

In the present embodiment, the angle area to which the bending angle of elbow joint can belong is divided into some segments, wherein this angle area ranges from the fully-bent-angle (i.e., angle $\theta$) to the fully-stretched-angle as shown in FIG. 5. More specifically, a first angle area POS1 ranges from $\theta_0$ to $\theta_1$, a succeeding uncertain angle area ranges from $\theta_1$ to $\theta_2$, a second angle area POS2 ranges from $\theta_2$ to $\theta_3$, another uncertain angle area ranges from $\theta_3$ to $\theta_4$ and a third angle area POS3 is set above $\theta_4$.

The CPU 22 detects the angle relation between the present angle data $\theta$ and old angle data $\theta$OLD which is generated 0.1 sec before to thereby judge the increasing or decreasing tendency of the bending angle of elbow joint. By considering such relation, the CPU 22 estimates and selects one of the angle areas POS1 to POS3 to which the future bending angle of elbow joint will belong as shown in FIG. 6.

More specifically, while the bending angle indicated by the angle data $\theta$ belongs to any one of the angle areas POS1 to POS3, one of the angle areas POS1 to POS3 is selected as the presumed angle area, regardless of the angle relation between the angle data $\theta$ and $\theta$OLD.

In the case where the bending angle indicated by the angle data $\theta$ belongs to the uncertain angle area and this bending angle tends to be decreasing (i.e., $\theta<\theta$OLD), the CPU 22 presumes that the future bending angle will belong to the angle area which is set smaller than the uncertain angle area. On the other hand, in the case where the angle data $\theta$ trends toward increasing (i.e., $\theta\geqq\theta$OLD), the CPU 22 presumes that the future bending angle will belong to the angle area which is set larger than such uncertain angle area. For example, in case of $\theta_1\leqq\theta\leqq\theta_2$, when the angle data $\theta$ trends toward decreasing (i.e., when $\theta<\theta$OLD), the CPU 22 presumes that the future bending angle will belong to the first angle area POS1. On the other hand, when the angle data $\theta$ trends toward increasing (i.e., when $\theta\geqq\theta$OLD), the CPU 22 presumes that the future bending angle will belong to the second angle area POS2.

Further, the CPU 22 selects one of nine kinds of musical scales $C_n$, $D_n$, . . . , $B_n$, $C_{n+1}$, $D_{n+1}$ (where n denotes the octave number) in response to the combination of presumed angle areas to which the future bending angles of right and left elbow joints will belong.

Figures 7, 8:
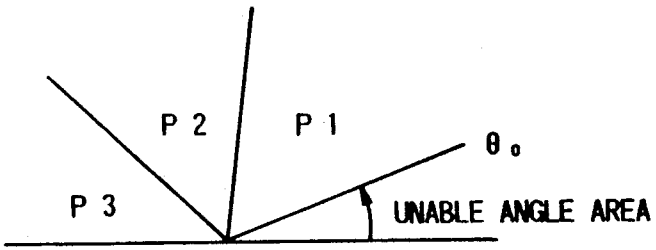
FIG. 7 shows corresponding relations between generated musical scales and the combination of the bending angles of right and left elbow joints.
FIG. 8 is a diagram for explaining a modified example of the present embodiment.

In the present embodiment described heretofore, at the present time when the key-on switch 30H of the grip device 50H is depressed, the CPU judges the increasing or decreasing tendency of the bending angles of right and left elbow joints based on the angle data $\theta$ at this present time stored in the registers 11R and 11L and the 0.1 sec old angle data $\theta$OLD stored in the registers 9R and 9L. By considering such judgement result, the CPU 22 determines the presumed angle areas to which the future bending angles of right and left elbow joints will belong. In response to the combination of the presumed angle areas for the right and left elbow joints, the CPU 22 determines the musical scale of the musical tone to be generated from the relations as shown in FIG. 7. Then, the CPU 22 generates the key code data KC corresponding to the determined musical scale, and such key code data KC with the key-on signal KON is supplied to the musical tone signal generating circuit 26. Thus, this circuit 26 generates the musical tone signal having the tone pitch corresponding to the key code data KC. Thereafter, the speaker 27 generates the musical tone corresponding to the musical tone signal.

As described heretofore, the present embodiment controls the musical tone based on the presumed angle areas to which the future bending angles of right and left elbow joints will belong respectively. Therefore, the performance speed can be raised. In addition, even when the key-on switch 30H is depressed before the bending angle of elbow joint comes to belong to the angle area for designating the next tone pitch of musical tone to be generated, it is possible to obtain the desirable tone pitch.

[B] Modified Example of Present Embodiment

Next, description will be given with respect to the modified example of the present embodiment. In this modified example, the bending angle of elbow joint is estimated as follows.

At first, the whole angle area ranging from the fully-bent-angle and fully-stretched-angle is perfectly divided into three angle areas P1 to P3 as shown in FIG. 8. Then, based on the formula of $\theta+(\theta\text{-}\theta\text{OLD})$, the presumed angle value $\theta$p is obtained. Thereafter, one of the angle areas P1 to P3 is selected as the angle area to which the presumed angle value $\theta$p belongs. In this case, it is possible to provide the predetermined limit value PL for $(\theta-\theta\text{OLD})$. Therefore, when $|\theta-\theta\text{OLD}|>\text{PL}$, it is possible to use the value PL as $(\theta-\theta\text{OLD})$.

Above is the description of the present invention. This invention may be practiced or embodied in still other ways without departing from the spirit or essential character thereof. For example, the present embodiment controls the tone pitch of the musical tone to be generated based on the combination of the bending angles of right and left elbow joints. However, it is possible to control the parameters other than the tone pitch, such as the tone color, tone volume and the like, by operating the switch provided to the grip device 50H. In addition, it is possible to detect another bending angle of wrist joint etc. other than the bending angle of player's elbow. In this case, it is possible to control the tone color, tone volume and the like based on the detected bending angle of wrist joint. Therefore, the preferred embodiment described herein is illustrative and not restrictive, the scope of the invention being indicated by the appended claims and all variations which come within the meaning of the claims are intended to be embraced therein.

What is claimed is:

1. A musical tone control apparatus comprising:

(a) angle detecting means for detecting and then outputting angle information corresponding to a bending angle at a joint portion of a player's body;

(b) operating means for designating a timing of generating a musical tone responsive to an operation by a player;

(c) first holding means for holding said angle information which is outputted from said angle detecting means at a designated timing, wherein said angle information to be held by said first holding means is set as present angle information;

(d) second holding means for holding other angle information which is outputted from said angle detecting means before said designated timing; and (e) control means for judging an increasing or decreasing tendency of said bending angle of a player's joint portion based on said present angle information and said other angle information, then estimating a future bending angle of a player's joint portion under consideration of judgement result thereof and generating musical tone control data for controlling a musical tone generating apparatus based on the estimation result thereof.

2. A musical tone control apparatus comprising:

(a) angle detecting means for detecting a bending angle of a player's joint portion to thereby generate a detection signal corresponding to said bending angle of the player's joint portion;

(b) operating means, responsive to an operation of a player, for designating a tone-generation timing;

(c) delay means for delaying said detection signal by a predetermined delay time;

(d) first means for temporarily holding said detection signal delayed by said delay means as old angle information;

(e) second means for temporarily holding said detection signal directly outputted from said angle detecting means as present angle information; and (f) control means for detecting a motion of said player's joint portion based on said old angle information and said present angle information to thereby estimate a future bending angle of the player's joint portion, so that said control means generates musical tone control data based on said future bending angle of the player's joint, whereby a musical tone is to be generated at said tone-generation timing based on said musical tone control data.

3. A musical tone control apparatus according to claim 2 wherein said first means further comprises:

(a) a first analog-to-digital converter for converting said detection signal delayed by said delay means to thereby obtain old angle data as said old angle information; and (b) a first register for temporarily holding said old angle data, and said second means further comprises:

(c) a second analog-to-digital converter for converting said detection signal directly outputted from said angle detecting means to thereby obtain present angle data as said present angle information; and (d) a second register for temporarily holding said present angle data.

4. A musical tone control apparatus according to claim 2 wherein said control means predetermines several angle areas by dividing a whole angle area to which said bending angle of player's joint portion can belong, whereby said control means generates said musical tone control data in accordance with one of said angle areas to which said future bending angle of player's joint portion belong.

5. A musical tone control apparatus according to claim 2 wherein said player's joint portion is a player's elbow joint portion.

6. A musical tone control apparatus according to claim 2 wherein said musical tone control data is key code data indicative of a key code corresponding to a tone pitch of the musical tone to be generated.

7. A musical tone control apparatus comprising:

(a) right angle detecting means for detecting a right bending angle at a player's right joint portion to thereby generate a right detection signal corresponding to said right bending angle;

(b) left angle detecting means for detecting a left bending angle at a player's left joint portion to thereby generate a left detection signal corresponding to said left bending angle;

(c) operating means, responsive to an operation of a player, for designating a tone-generation timing;

(d) right holding means for temporarily holding said right detection signal as present right angle information, said right holding means also delaying said right detection signal by a predetermined delay time to thereby temporarily hold a delayed right detection signal as old right angle information;

(e) left holding means for temporarily holding said left detecting signal as present left angle information, said left holding means also delaying said left detection signal by the predetermined delay time to thereby temporarily hold a delayed left detection signal as old left angle information; and (f) control means for detecting a motion of said player's right joint portion based on said present right angle information and said old right angle information to thereby estimate a future right bending angle, said control means also detecting a motion of said player's left joint portion based on said present left angle information and said old left angle information to thereby estimate a future left bending angle, so that said control means generates musical tone control data based on a combination of said future right and left bending angles, whereby a musical tone is to be generated at said tone-generating timing based on said musical tone control data.

* * * * *